US005140132A

United States Patent [19]

Shiokawa

[11] Patent Number: 5,140,132

[45] Date of Patent: Aug. 18, 1992

[54] METHOD OF AND APPARATUS FOR CONTROLLING FIXING DEVICE IN ELECTROPHOTOGRAPHIC RECORDING SYSTEM

[75] Inventor: Masami Shiokawa, Tokyo, Japan

[73] Assignee: Seikosha Co., Ltd., Tokyo, Japan

[21] Appl. No.: 715,059

[22] Filed: Jun. 13, 1991

Related U.S. Application Data

[63] Continuation of Ser. No. 458,125, Dec. 28, 1989, abandoned.

[30] Foreign Application Priority Data

Dec. 29, 1988 [JP] Japan ..... 63-331211

[51] Int. Cl.[5] ..... G03G 15/20

[52] U.S. Cl. ..... 219/216; 219/490; 219/494; 355/282; 355/285

[58] Field of Search ..... 355/204, 208, 282, 285, 355/77; 219/216, 497, 490, 494; 430/9, 124

[56] References Cited

U.S. PATENT DOCUMENTS

| | | | |
|---|---|---|---|
| T100,804 | 7/1981 | Ernst | 355/208 X |
| 4,113,375 | 9/1978 | Murata et al. | 355/285 |
| 4,348,102 | 9/1982 | Sessink | 355/285 |
| 4,415,800 | 11/1983 | Dodge et al. | 219/216 X |
| 4,512,649 | 4/1985 | Derimiggio | 355/208 X |
| 4,603,245 | 7/1986 | Yagasaki | 355/285 X |
| 4,868,368 | 9/1989 | Araki | 219/497 X |

*Primary Examiner*—A. T. Grimley
*Assistant Examiner*—J. E. Barlow, Jr.
*Attorney, Agent, or Firm*—Jordan and Hamburg

[57] ABSTRACT

A method and an apparatus for controlling a fixing device in an electrophotographic recording system provides for periodically sampling the temperature of the fixing device, detecting whether the sampled temperature of the fixing device is on an upward trend of a downward trend, and controlling the on/off operation of the fixing device on the basis of the detected trend and on a predetermined changeover temperature range.

4 Claims, 2 Drawing Sheets

METHOD OF AND APPARATUS FOR CONTROLLING FIXING DEVICE IN ELECTROPHOTOGRAPHIC RECORDING SYSTEM

This application is a continuation of application Ser. No. 07/458,125, filed Dec. 28, 1989, now abandoned.

BACKGROUND OF THE INVENTION

1. Field of the Invention

The present invention relates to an apparatus for and a method of controlling a fixing device in an electrophotographic recording system.

2. Description of the Related Art

With a conventional control method and a control apparatus of the type described above, the temperature of a fixing device is first measured by a thermal sensor to monitor its value, and after a determination is made as to whether or not the temperature is at a favorable level, the fixing device is held in its state for a fixed period of time set by the timer. For example, in a case where the desired fixing temperature is set at 180° C., when a value of 179° C. is obtained by monitoring at a fixed period of time after turning on the fixing device, the fixing device is controlled to remain in its on state. After a fixed period of time set by the timer has elapsed, e.g. 0.3 second, the temperature of the fixing device is monitored again, and if the temperature is detected to have reached 181° C., the fixing device is controlled to an off state. Then, if the value of the temperature monitored after another fixed period of time is 180° C., the fixing device is held as it is in the off state. However, if it is 179° C., the fixing device is controlled to the on state.

However, with such a control method wherein a determination is made by monitoring the temperature at fixed intervals by means of a timer whether the temperature is above or below a fixed level, there is a high frequency of changeover between the on and off states of the fixing device. As a result, a voltage drop is liable to occur due to an inrush of current to a load (e.g., a halogen lamp), possibly exerting an adverse effect on peripheral equipment. In addition, there are cases where the on/off operation of the fixing device is effected by making an erroneous determination due to very small noises or the like on the line of a thermal sensor for monitoring the temperature. An externally mounted circuit becomes necessary in order to prevent this from occurring. Furthermore, there are cases where, due to a slight delay in the monitoring timing, the fixing device fails to be controlled to the off state until its temperature reaches a higher temperature than is required, or fails to be controlled to the on state until it conversely reaches a lower temperature than is required.

SUMMARY OF THE INVENTION

Accordingly, an object of the present invention is to provide a method of stably controlling the temperature of a fixing device which is capable of constantly controlling the temperature within a desired range without turning on or off the fixing device more frequently than is required, of suppressing an unnecessary inrush of current to a load, and of undergoing no malfunctioning due to very small noises on the line of a thermal sensor.

Another object of the present invention is to provide an apparatus for controlling the temperature of a fixing device which is capable of preventing the shortening of the life of a load and does not require a timer and an externally mounted circuit.

To this end, in accordance with the present invention, there is provided a method of controlling a fixing device in an electrophotographic recording system, comprising the steps of: periodically sampling a temperature of the fixing device; detecting on the basis of the sampled result whether the temperature of the fixing device is on an upward trend or a downward trend; and controlling the on/off operation of the fixing device on the basis of the detected result and a predetermined changeover temperature range.

In accordance with one aspect of the invention, there is provided an apparatus for controlling a fixing device in an electrophotographic system, comprising: sampling means for periodically sampling the temperature of the fixing device; detecting means for detecting on the basis of the sampled result whether the temperature of the fixing device is on an upward trend or a downward trend; and controlling means for controlling the on/off operation of the fixing device on the basis of the result of detection of a trend of a temperature change and a predetermined changeover temperature range.

The above and other objects, features and advantages of the invention will become more apparent from the following detailed description of the invention when read in conjunction with the accompanying drawings.

DESCRIPTION OF THE PREFERRED EMBODIMENTS

Figure 1:
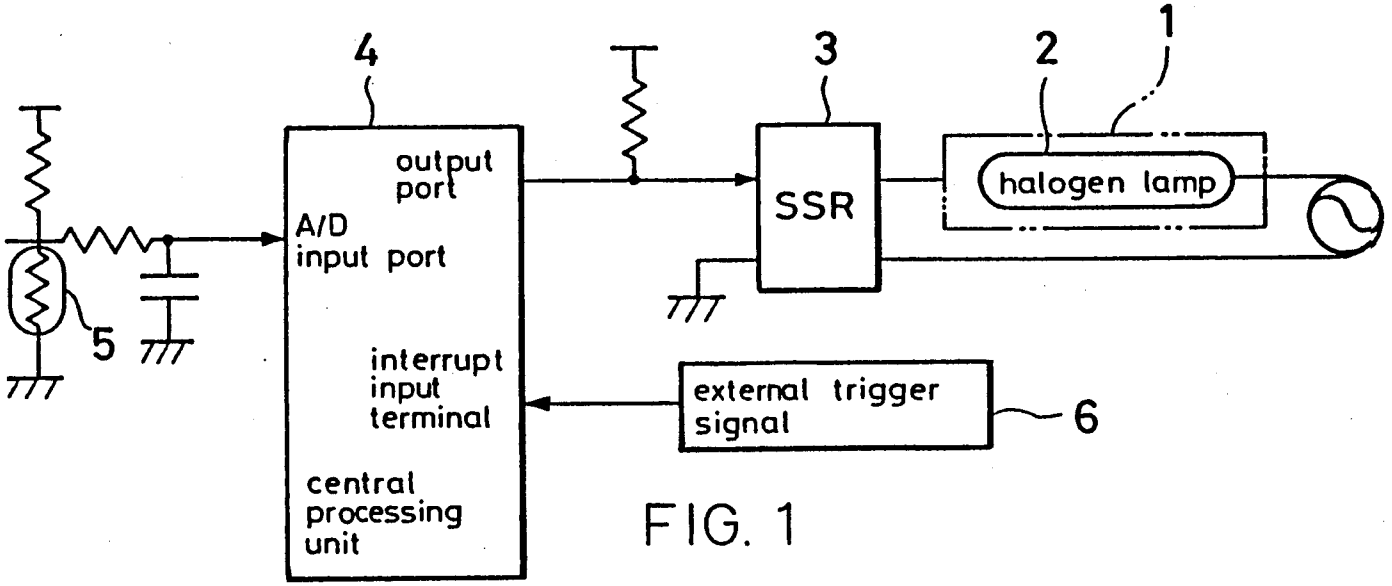
FIG. 1 is a block diagram schematically illustrating a control apparatus of the invention.

As shown in the block diagram of FIG. 1, in a control apparatus in accordance with the present invention, a halogen lamp 2 for heating a fixing device 1 is incorporated in the fixing device 1. This halogen lamp 2 is connected to an output port of a central processing unit 4 via an electronic control device 3 such as a relay (SSR) for controlling the on/off operation of the halogen lamp 2. A thermal sensor 5 is used for measuring the temperature of the fixing device 1, and is connected to an input port of the central processing unit 4. The measuring of the temperature of the fixing device 1 by the thermal sensor 5 is effected for each period of an external trigger signal 6 of a fixed cycle (e.g., 100 Hz) supplied to an interrupt input terminal of the central processing unit 4, and a sampling means 7 (shown in FIG. 4) for periodically sampling the temperature T of the fixing device 1 is provided. In addition, a detection means 8 (shown in FIG. 4) is also provided for detecting whether a temperature change is on an upward trend or a downward trend as a result of comparing the measured temperature thus sampled periodically. The central processing unit 4 has a control means 9 (shown in FIG. 4) which will be described later and is adapted to control the on/off operation of the fixing device 1 on the basis of the detected result of the trend of the temperature change by the detection means 8 as well as a predetermined changeover temperature range.

Figure 2:
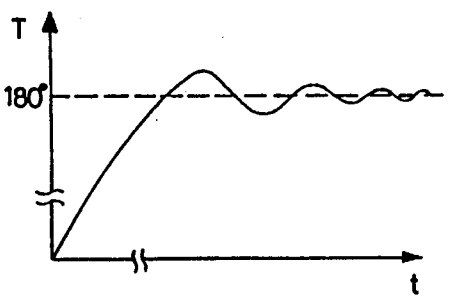
FIG. 2 is a graph illustrating fluctuations in the temperature of a fixing device.

FIG. 2 illustrates fluctuations in the temperature of the fixing device 1 from the time of the turning on of a power source in a case where the temperature T of the fixing device 1 is controlled to a fixed temperature of 180° C. in accordance with a control method of the present invention and by the control apparatus thereof.

Figure 3:
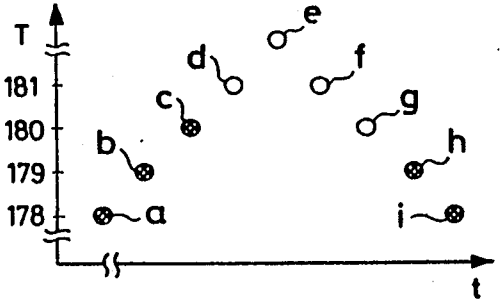
FIG. 3 is a graph illustrating the sampling of the temperature of the fixing device.
Figure 4:
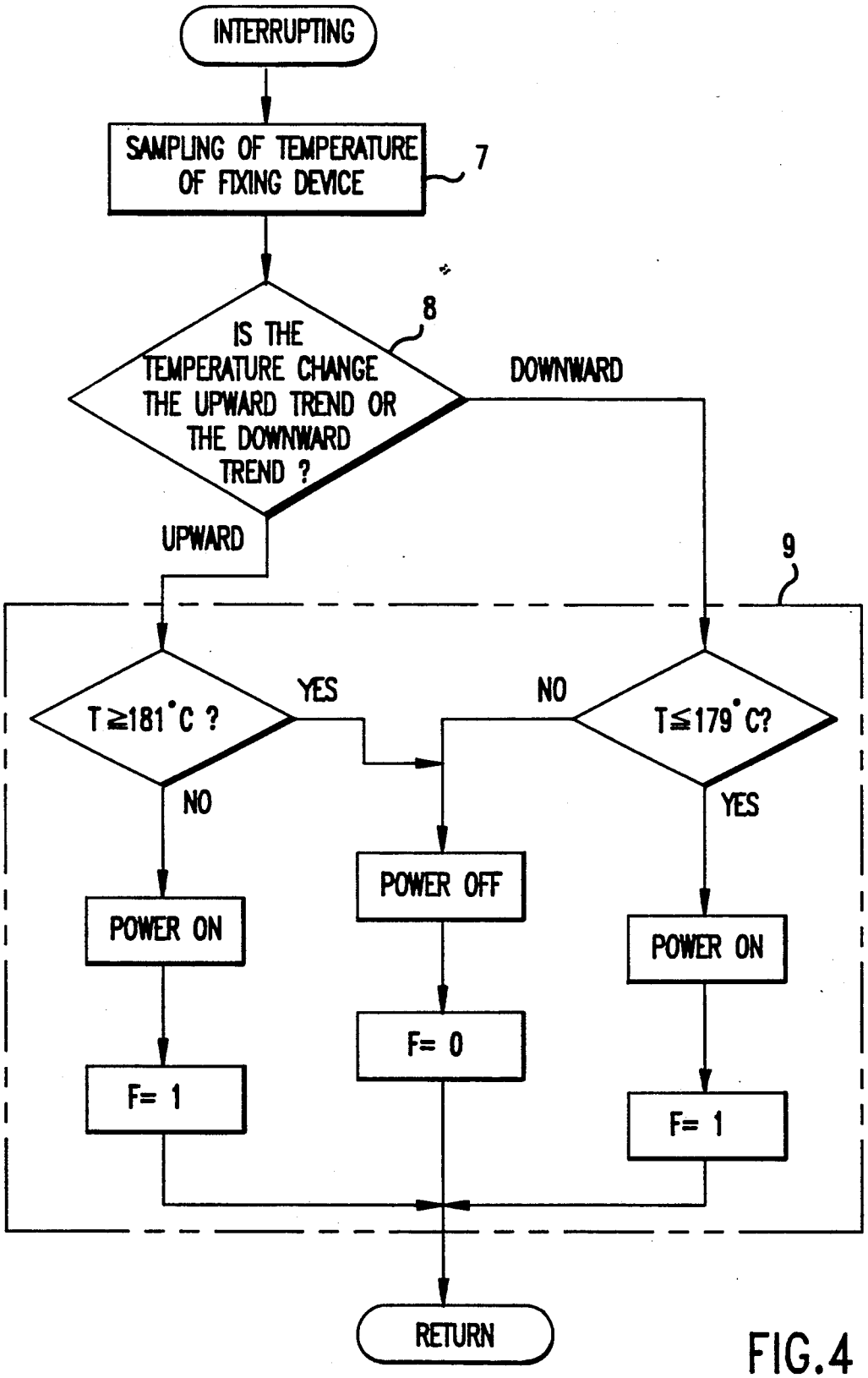
FIG. 4 is a flowchart of a control operation.

FIG. 3 illustrates a sampling of the temperature of the fixing device 1, in which parts of a rise and drop in the temperature are enlarged. Referring now to FIG. 4, a detailed description will now be given of the control operation in accordance with the present invention.

After the power source is turned on, the temperature of the fixing device 2 rises, and each time the external trigger signal 6 is inputted to the interrupt input terminal of the central processing unit 4, as shown in FIG. 4, the temperature T of the fixing device 1 measured by the thermal sensor 5 is sampled by the sampling means 7, thereby obtaining samplings a–i shown in FIG. 3. On the basis of this sampled result, whether the temperature change is on an upward trend or a downward trend is detected by the detecting means 8. If it is assumed that the temperature measured just now is 178° C. shown at the sampling a, since the temperature is lower than the fixed temperature of 180° C. to which it is to be controlled, and that temperature is rising as compared to a previous temperature, a determination is made that the temperature change shows an upward trend. In the case of an upward trend, since the changeover temperature T is set in advance to $T \geqq 181°$ C., unless the temperature has not reached this level, the fixing device 1 remains in the on state, and the detection means 8 supplies a flag signal "1" to the control means 9, which indicates that the temperature change is on an upward trend. This sampling is repeated for each period of the external trigger signal 6, and samplings b, c indicated by dots in FIG. 3 are obtained. Since the temperature has not reached the changeover temperature T in either case, the fixing device 1 remains on. In the case of sampling d shown by a following circle, $T \geqq 181°$ C. is finally met, whereupon the fixing device 1 is controlled to the off state for the first time. Ordinarily, since a delay in the response time occurs to the thermal sensor 5 itself, the temperature rises slightly (sampling e) for a short time even after the fixing device 1 is turned off, and the temperature then starts to decline. The detection means 8 detects this decline and supplies a flag signal "0" to the control means 9, which indicates that the temperature change is the downward trend. Since the changeover temperature T is set in advance to be $T \leqq 179°$ C. in the case of the downward trend, the temperature T has not dropped to 179° C. in the case of samplings f and g, so that the fixing device 1 remains off. In an ensuring sampling h, however, the temperature $T \leqq 179°$ C. is met, so that the fixing device 1 is controlled to the on state. In this case as well, even if the fixing device 1 is set in the on state, the temperature declines slightly (sampling i) as in the aforementioned case. As the temperature begins to rise, the detection means 8 supplies the flag signal "1" to the control means 9 again.

In other words, in FIG. 3, in the case of the samplings a to c, h, i indicated by the dots the fixing device 1 is in the on state, while in the case of the samplings d–g the fixing device 1 is in the off state. In addition, in the case of the samplings a to e, the detection means 8 supplies the flag signal "1" to the control means 9, while in the case of the samplings e to i the detection means 8 supplies the flag signal "0" to the control means 9.

As described above, in accordance with the method of the invention for controlling a fixing device, the fixing device can be controlled in such a manner that its temperature is kept within a narrow range above and below a desired temperature without the fixing device being turned on and off more frequently than is required. Furthermore, since an unnecessary inrush current to a load is suppressed and the fixing device does not undergo a malfunctioning due to very small noises on the line of a thermal sensor, it is possible to stably effect the temperature control of the fixing device.

In addition, in accordance with the control apparatus of the present invention, it is possible to prevent the life of a load from becoming shortened, and the fixing device can be arranged simply without requiring a timer and an externally mounted circuit.

Although the present invention has been described through specific terms, it should be noted here that the described embodiments are not necessarily exclusive and that various changes and modifications may be imparted thereto without departing from the scope of the invention which is limited solely by the appended claims.

What I claim is:

1. A method of controlling a fixing device in an electrophotographic recording system, comprising the steps of:

periodically sampling the temperature of said fixing device;

detecting whether the periodically sampled temperature of said fixing device is on an upward trend or a downward trend;

providing a first signal when said sampled temperature is on an upward trend and a second signal when said sampled temperature is on said downward trend;

providing a first changeover control which is operable to change over a fixing device heater from an on state to an off state;

setting a first predetermined temperature in said first changeover control;

utilizing said first signal to effect enabling of said first changeover control such that when enabled, said first changeover control is operable to change over said fixing device heater from said on state to said off state when said fixing device attains said first predetermined temperature;

providing a second changeover control which is operable to change over said fixing device heater from an off state to an on state;

setting a second predetermined temperature in said second changeover control; and utilizing said second signal to effect enabling of said second changeover control such that when enabled, said second changeover control is operable to change over said fixing device heater from said off state to said on state when said fixing device attains said second predetermined temperature.

2. A method according to claim 1 further comprising sampling the temperature of said fixing device at each period of a trigger signal.

3. Apparatus for controlling a fixing device in an elecrophotographic recording system, wherein the fixing device has a heating means comprising:

sampling means for periodically sampling the temperature of said fixing device;

detecting means for detecting whether the periodically sampled temperature of said fixing device is on an upward trend of a downward trend and for providing a first signal when said sampled temperature is on said upward trend and a second signal when said sampled temperature is on said downward trend;

a first changeover control means settable to a first predetermined temperature and operable to change over said heating means from an on state to an off state when said fixing device attains said first predetermined temperature;

a second changeover control means settable to a second predetermined temperature and operable to change over said heating means from an off state to an on state when said fixing device attains said second predetermined temperature;

said first changeover control means being enabled when receiving said first signal, said second changeover control means being enabled when receiving said second signal.

4. Apparatus according to claim 3 wherein said sampling means comprises means producing a trigger signal, said sampling means further comprising a sensor for sensing the temperature of said fixing device for each period of said trigger signal.

* * * * *